US006185776B1

(12) United States Patent
Windmeisser

(10) Patent No.: US 6,185,776 B1
(45) Date of Patent: Feb. 13, 2001

(54) ASSEMBLY FOR A HEAD OF A SURFACE MAINTENANCE MACHINE AND MACHINE COMPRISING SUCH

(75) Inventor: Dieter Windmeisser, Munchwilen (CH)

(73) Assignee: Diversey Lever, Inc., Plymouth, MI (US)

( * ) Notice: Under 35 U.S.C. 154(b), the term of this patent shall be extended for 0 days.

(21) Appl. No.: 09/166,443

(22) Filed: Oct. 5, 1998

(30) Foreign Application Priority Data

Oct. 6, 1997 (EP) ..... 97203064

(51) Int. Cl.[7] ..... A47L 11/16

(52) U.S. Cl. ..... 15/49.1; 15/50.1; 15/97.1; 15/98

(58) Field of Search ..... 15/49.1, 98, 50.1, 15/97.1

(56) References Cited

U.S. PATENT DOCUMENTS 1,677,533 * 7/1928 Staehle .
4,271,557 * 6/1981 Caron .
4,319,434 3/1982 Brejcha .
4,463,469 * 8/1984 Green .
5,507,061 4/1996 Miyazaki .
5,579,554 12/1996 Plazanet .
5,849,097 12/1998 Windmeisser .
5,875,506 * 3/1999 Plazanet .

FOREIGN PATENT DOCUMENTS 39 22 552 1/1991 (DE) .
049 885 4/1982 (EP) .

OTHER PUBLICATIONS

European Search Report dated Mar. 6, 1998.

* cited by examiner

*Primary Examiner*—Deborah Jones
*Assistant Examiner*—Jennifer McNeil

(57) ABSTRACT

The invention relates to an assembly for a head of a surface maintenance machine, said assembly comprising:

Figure 1:
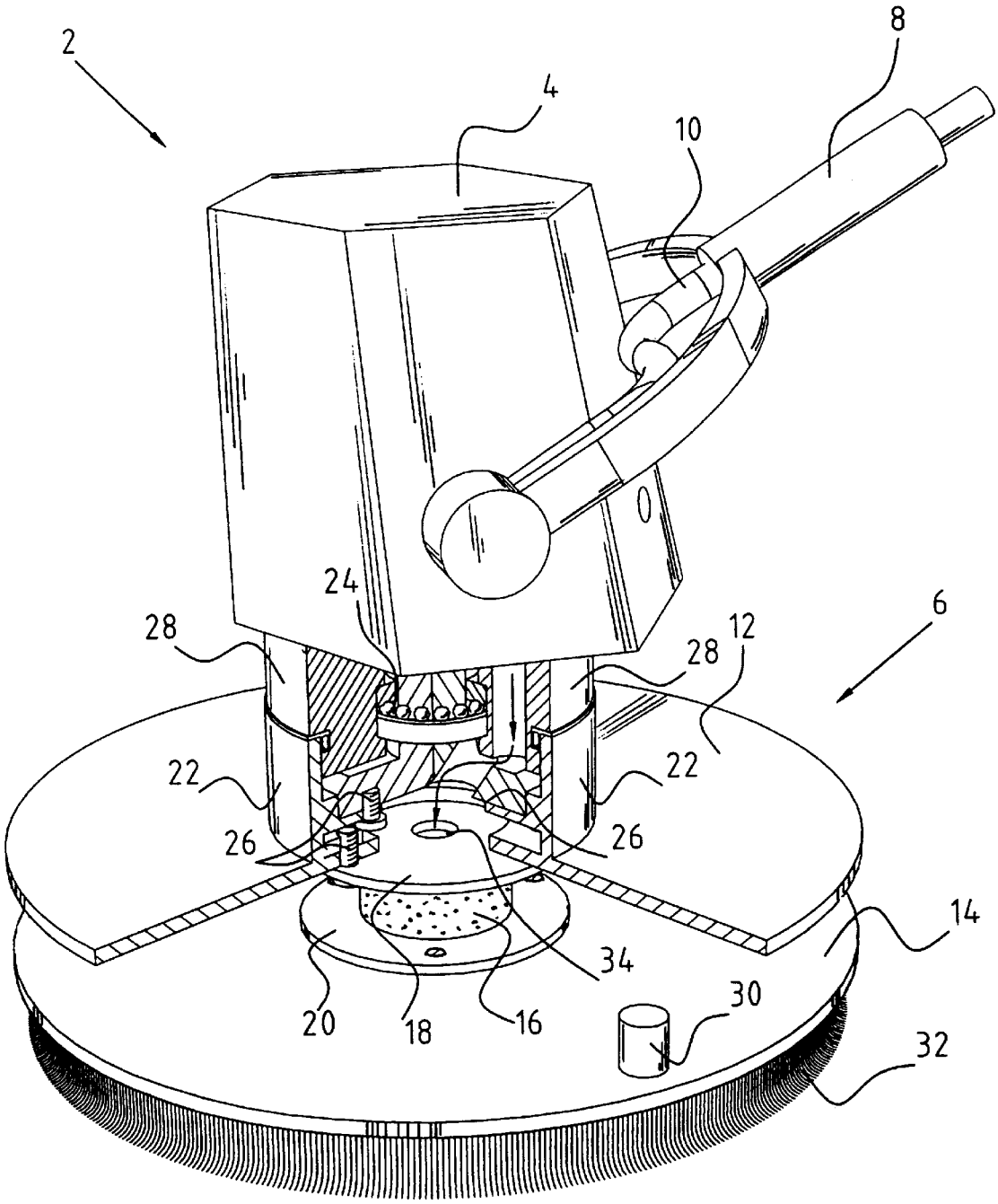

scrubbing means for directly contacting, scrubbing/maintaining surfaces such as floors, walls and the like;

support means for the scrubbing means, whereunder the scrubbing means are arranged;

buffer means arranged on the opposite side of the support means to the scrubbing means, for absorbing forces exerted during operation of the surface maintenance machine;

coupling means in association with the buffer means for coupling the scrubbing means to a motor of the surface maintenance machine, wherein the buffer means are centrally positioned with regard to the coupling and scrubbing

11 Claims, 2 Drawing Sheets

ASSEMBLY FOR A HEAD OF A SURFACE MAINTENANCE MACHINE AND MACHINE COMPRISING SUCH

FIELD OF THE INVENTION

The present invention relates to an assembly for a head of a surface maintenance machine, a surface maintenance machine comprising such, and to a process of surface maintenance.

BACKGROUND OF THE INVENTION

Surface maintenance machines, for example hand-held surface scrubbers which typically have a rotatable head attached to an elongated handle, wherein a motor situated in the head causes a series of brushes or a cleaning pad to rotate, suffer handling problems caused by vibrations due to unbalanced paddrives, pads or brushes. These vibration problems are especially disturbing on high speed machines, whereby the brushes and the pads rotate up to 400 rpm, and make such surface maintenance machines very difficult to operate and manage, and have even led in some cases to operator injury. These machines are very difficult to control since they typically operate at a frequency of 6.6 movements per second which is difficult to follow with the hand. Furthermore the scrubbing pads and brushes often become deformed through use which increases the vibrations travelling through the head. These handling problems caused by vibrations when operating surface maintenance machines, have been recognised in the prior art. For instance, U.S. Pat. No. 5,507,061 refers to a rotary brush floor polisher containing shock absorbing members which are indicated to reduce vibrations and noise in operation. The floor polisher disclosed in this document contains an upper disk and a lower disk which are connected to each other by a plurality of bolts arranged around the perimeter of the upper disk which bolts are associated with shock absorbers. However, this rather complicated constuction does not fully eliminate vibrations when operating the floor polisher.

Another type of problems relating to known surface maintenance machines is concerned with the following. On starting up known surface maintenance machines, a high torque has to be produced in order for an effective working status to be achieved whereby a high current is required which often greatly exceeds the limitation set by fuses within the machine and at the source. This has led to the problem of fuses often blowing on starting up such machines. Furthermore during the start up period, especially on rough surfaces, a large "contra-torque", which can be unmanageable, must be exerted by the operator in order to remain in control over the machine. An object of the present invention is to provide a head assembly for a surface maintenance machine which substantially overcomes one or more of these problems.

DEFINITION OF THE INVENTION

According to a first aspect of the present invention there is provided an assembly for a head of a surface maintenance machine, said assembly comprising:

- scrubbing means for directly contacting, scrubbing/maintaining surfaces such as floors, walls and he like;
- support means for the scrubbing means, whereunder the scrubbing means are arranged;
- buffer means arranged on the opposite side of the support means to the scrubbing means, for absorbing forces exerted during operation of the surface maintenance machine;

- coupling means in association with the buffer means for coupling the scrubbing means to a motor of the surface maintenance machine, wherein the buffer means are centrally positioned with regard to the coupling and scrubbing means. According to a second aspect, there is provided a surface maintenance machine comprising an assembly according to the present invention. According to a third aspect, there is provided a method of maintaining a surface using such an assembly.

DETAILED DESCRIPTION OF THE INVENTION

The inventors have found that by arranging a buffer between the motor coupling and the scrubbing/maintenance means, vibrations in substantially all directions are able to be buffered and dissipated such that the handling ease of such a machine is greatly facilitated. Since an imaginary axis preferably substantially bisects the coupling and scrubbing means and also the buffer, deformation of the buffer is substantially obviated due to its "centrally aligned position", whereby any unbalanced mass of the head assembly is reduced within a handle of the machine itself.

The buffer means are preferably substantially elastic in nature and can have a predetermined hardness whereby on starting up of the machine, the buffer first "turns in on itself" to act as a kind of soft start whereby vibrations travelling through the machine are reduced.

The buffer means are preferably "sandwiched" between support means, arranged between the coupling means and the buffer means, whereby these support means preferably extend out over the edges of the buffer so that the scrubbing/maintaining means can directly follow the contour of a surface and whereby the buffer therefore acts as a sort of cardanic unit and absorbs movements of the lower plate which may be caused by travelling over contoured surfaces.

A good effectivity is provided when the buffer comprises a rubber block which is vulcanized to the support means which preferably complies metal plates. Safety means to ensure that the two plates are prevented from clashing together on operation are preferably arranged therebetween.

Figure 2:
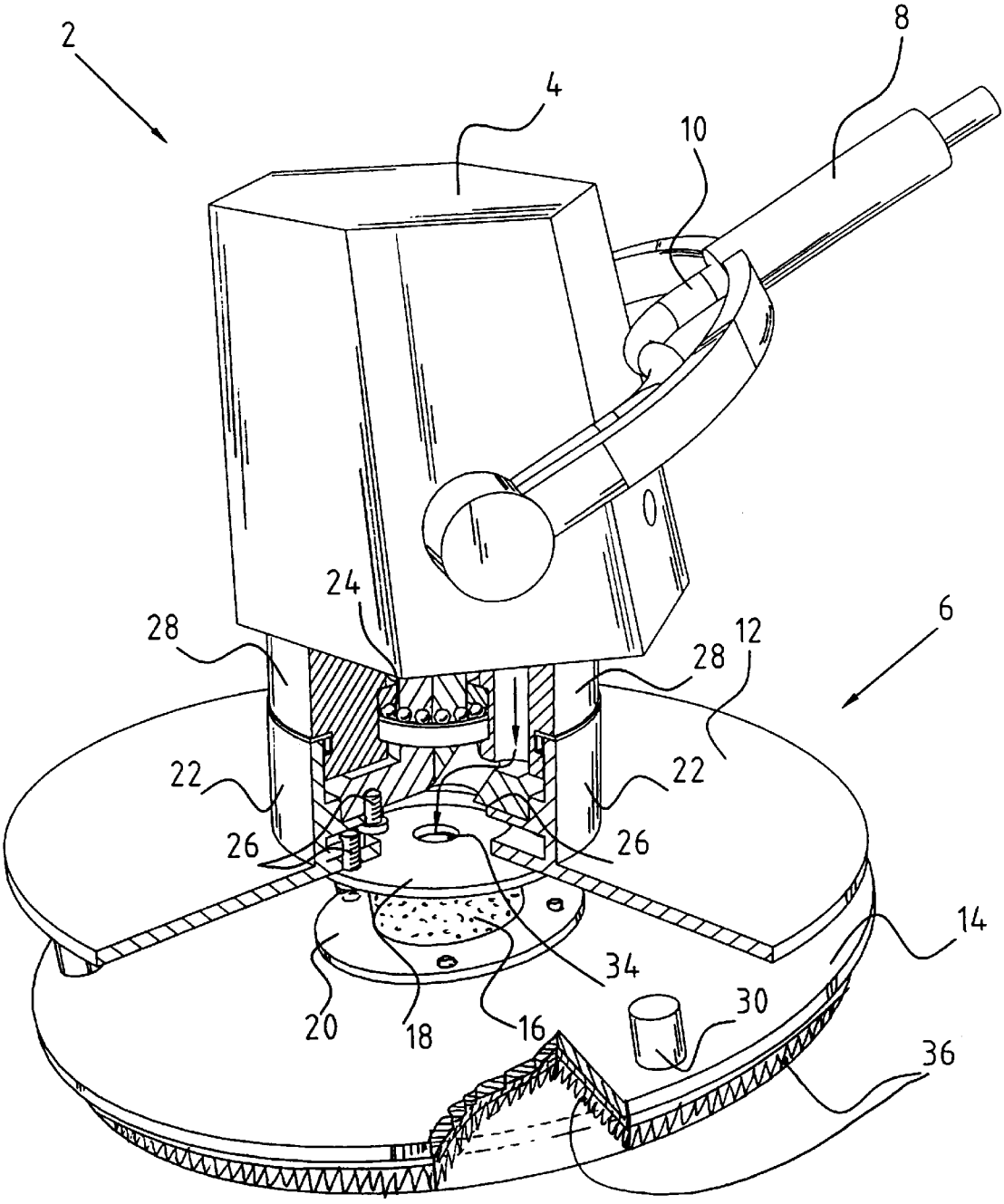

The invention will now be described by way of the following description which refers to the figures wherein:

- FIG. 1 shows a partly cut away perspective view of a cleaning head of a surface maintenance machine according to the present invention, and
- FIG. 2 shows the embodiment from FIG. 1 provided with a cleaning pad instead of cleaning brushes.

An assembly 2, being a preferred embodiment of the present invention ( see FIGS. 1 and 2 ), comprises a power head 4 and a scrubber unit 6 arranged thereunder. A hingable handle 8 is attached to the power head 4 wherein a motor is housed. A power cable 10 runs through the handle 8 from the power head 4 for supplying power to the motor. The scrubber unit 6 has an upper plate 12 and a lower plate 14 where between a buffer block 16 is secured by means of an upper securing plate 18 and a lower securing plate 20 respectably, which are bolted to the upper and lower plates 12 and 14 respectably. An upstanding securing rim 22 of the upper plate 12 is co-operably coupled with a central drive axle 24 coupled to the motor, not shown, by means of bolts 26. A rotatable housing part 28 is arranged between the power head 4 and the upstanding rim 22. Arranged below the lower plate 14 are a series of brushes 32, see FIG. 1, or a cleaning pad 36, as shown in FIG. 2.

Safety struts 30 are provided on the upper surface of the lower plate 14 near the perimeter thereof, to prevent excessive mutual displacement and clashing together of the upper and lower plates during use, see especially FIG. 2.

A central channel 34 extends through the upper plate 12, the upper securing plate 18, the buffer block 16, the lower securing plate 20 and the lower plate 14 to open into the cleaning brushes or pad wherethrough cleaning agent can be dispensed when required.

In use, the operator controls the maintenance machine via the handle 8 and controls associated therewith, not shown, whereby the rotatable axle 24 is driven which in turn drives the rotatable housing 28, the upper plate 12, and hence the buffer block 16 whereby the lower plate 14 is also rotatably driven in order to provide the rotating cleaning/scrubbing action of the brush/pad. Forces occurring during operation of the machine are buffered by the buffer block 16 whereby the upper and lower plates are mutually displaceable, see FIG. 2, in order to ensure good cleaning/scrubbing effectivity and ease of handling of the machine.

The invention is not limited to the above specific description, but is rather determined by the following claims.

What is claimed is:

1. Assembly for a head of a surface maintenance machine, said assembly comprising:

scrubbing means (32, 36) for directly contacting surfaces;

a first support means (18, 20) having a first diameter for the scrubbing means, whereunder the scrubbing means are arranged;

buffer means (16) arranged between the first support means, for absorbing forces exerted during operation of the surface maintenance machine;

coupling means (22, 28) in association with the buffer means for coupling the scrubbing means to a motor of the surface maintenance machine;

a second support means (12, 14), arranged on both sides of the buffer means, said second support means (12, 14) having a diameter greater than the first diameter of said first support means (18, 20), wherein the buffer means (16) are centrally positioned with regard to the coupling and scrubbing means.

2. Assembly according to claim 1, wherein an imaginary axis substantially bisecting the coupling and the scrubbing means, also substantially bisects the buffer means.

3. Assembly according to claim 1, wherein the buffer means (16) are substantially elastic in nature.

4. Assembly according to claim 1, wherein the scrubbing means comprise brushes (32) or a pad (36).

5. Assembly according to claim 1, wherein the buffer means (16) comprises rubber or a synthetic material.

6. Assembly according to claim 1, wherein each of the second support means (12, 14) comprise a metal plate.

7. Assembly according to claim 6, wherein the buffer means (16) comprise a rubber block vulcanized to the metal plates.

8. Assembly according to claim 7, wherein the metal plates and the rubber buffer are provided with a channel (34) extending therethrough for administering cleaning agents.

9. Assembly according to claim 6, further comprising safety means (30) for preventing the plates of the second support means (12, 14) from clashing together during operation.

10. A surface maintenance machine comprising an assembly according to claim 1.

11. Method of maintaining a surface and facilitating the ease of operator handling of a surface maintenance machine, comprising the step of operating a machine according to claim 10 for surface maintenance.

* * * * *